United States Patent [19]

Bender

[11] Patent Number: 4,585,080

[45] Date of Patent: Apr. 29, 1986

[54] PORTABLE ROTARY EARTH DRILLING APPARATUS

[76] Inventor: Calvin P. Bender, 16750 E. Ada Pl., Aurora, Colo. 80012

[21] Appl. No.: 698,085

[22] Filed: Feb. 4, 1985

[51] Int. Cl.[4] ..... E21B 3/02; E21C 1/00

[52] U.S. Cl. ..... 175/170; 175/202; 175/203; 175/315; 173/29

[58] Field of Search ..... 175/162, 170, 202, 203, 175/315; 173/29, 37, 39

[56] References Cited

U.S. PATENT DOCUMENTS

| | | | |
|---|---|---|---|
| 313,204 | 3/1885 | Grooms | 173/39 X |
| 2,521,895 | 9/1950 | Bunting | 175/170 X |
| 4,158,520 | 6/1979 | Prebenson | 173/29 X |
| 4,192,393 | 3/1980 | Womack et al. | 175/103 |
| 4,476,940 | 10/1984 | Reichert et al. | 173/37 |

FOREIGN PATENT DOCUMENTS

| | | | |
|---|---|---|---|
| 2305549 | 10/1976 | France | 175/203 |
| 275773 | 10/1964 | Netherlands | 175/203 |
| 6709545 | 1/1968 | Netherlands | 175/203 |

*Primary Examiner*—Stephen J. Novosad
*Assistant Examiner*—John F. Letchford
*Attorney, Agent, or Firm*—Fields, Lewis, Pittenger & Rost

[57] ABSTRACT

For drilling holes in remote locations there is provided drilling apparatus consisting of hand-transportable modules which include a base assembly (12), a derrick (13) removably mounted on the base assembly and including an elongated tubular member (51) and a carriage (52) moved along the tubular member by a block and tackle (81), and a hydraulic cylinder (97). The carriage has a detachable support portion (55) that supports a drill assembly (14) on one side of the derrick for drilling and an anchor assembly (15) on the other side of the derrick for anchoring the base assembly to the earth's surface. A hydrostatic drive system (17) selectively actuates the carriage, drill and anchor.

17 Claims, 11 Drawing Figures

PORTABLE ROTARY EARTH DRILLING APPARATUS

TECHNICAL FIELD

This invention relates to drilling apparatus and more particularly to novel and improved portable rotary earth drilling apparatus that is capable of being hand-carried to remote locations.

BACKGROUND ART

Rotary drilling apparatus is employed in the petroleum industry to drill holes in which dynamite explosives are set off for seismic exploration.

Portable drilling rigs have heretofore been developed for use in remote locations where it is difficult to transport and locate more conventional earth drilling equipment. A recently developed portable drilling rig that is helicopter-transported is disclosed in Womack et al. U.S. Pat. No. 4,192,393. The rig disclosed in the Womack et al. patent features three modular components each weighing less than 1300 pounds so as to be capable of transportation by a relatively inexpensive helicopter. Prior known derricks used in portable drilling rigs have required a derrick with chains and sprockets or continuous screw structure to move the load. The disadvantage of this structure is that it is relatively heavy, readily becomes dirty so as to require cleaning, and further is relatively slow in operation.

DISCLOSURE OF INVENTION

The earth drilling apparatus disclosed is particularly suited to be manually transported to remote locations. The apparatus includes a base assembly and a derrick supported by the base assembly having a carriage adapted to alternately support an anchor for anchoring the base assembly to the earth's surface and a drill assembly for drilling into the earth. The derrick includes an elongated tubular member, an internal block and tackle, an associated fluid drive system for driving the drill motor, and a hydraulic cylinder. This arrangement is especially fast in drilling the holes such as for seismic exploration.

BRIEF DESCRIPTION OF DRAWINGS

The details of this invention will be described in connection with the accompanying drawings, in which.

DETAILED DESCRIPTION

Figure 1:
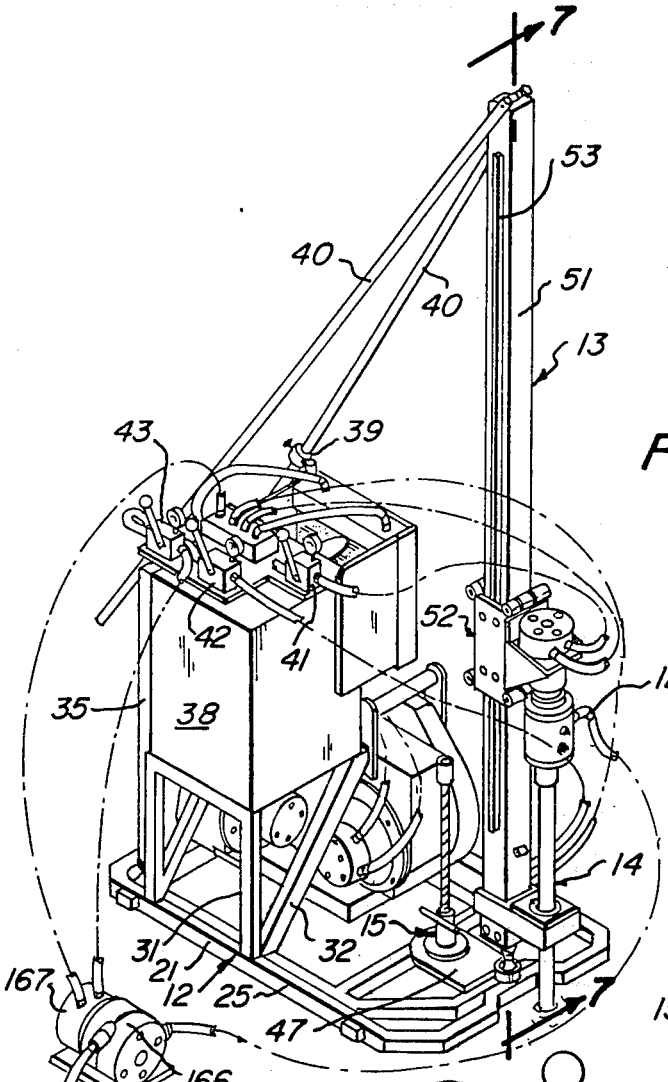
FIG. 1 is a perspective view of a drilling apparatus embodying features of the present invention shown anchored to the earth.
Figure 3:
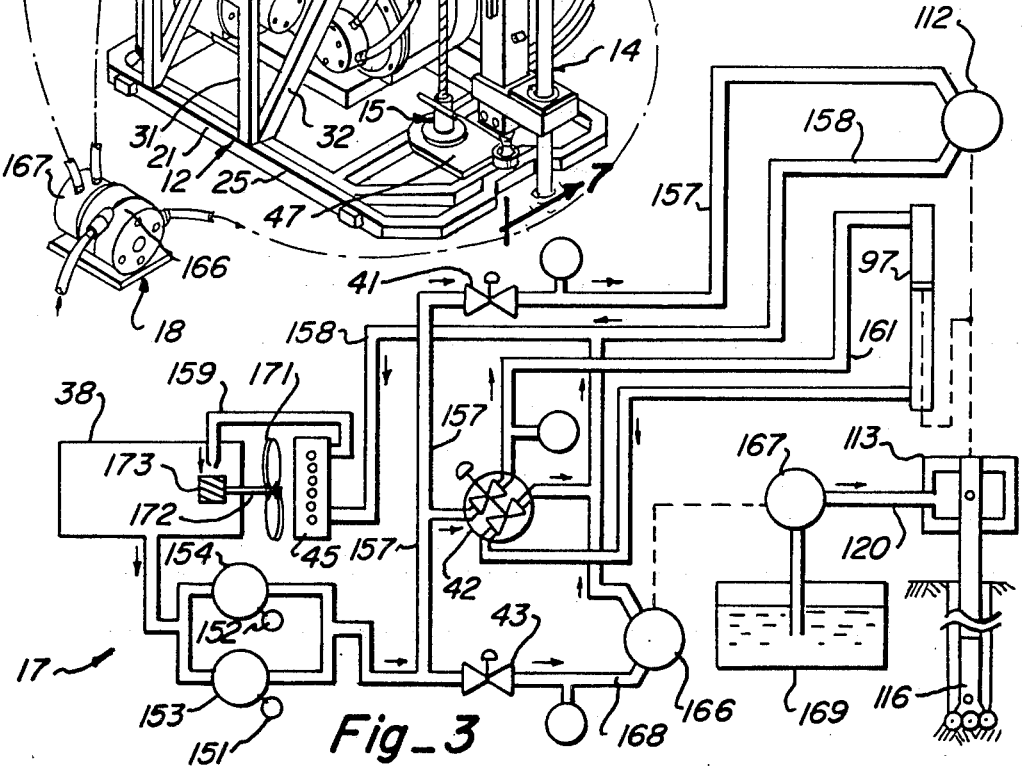
FIG. 3 is a schematic diagram of the drive system portion of the apparatus.

Referring now to FIG. 1, there is shown drilling apparatus embodying features of the present invention which, generally stated, is comprised of a base assembly 12, a derrick 13, a drill assembly 14, and an anchor assembly 15. A hydrostatic drive system 17 is schematically shown in FIG. 3. An optional mud pump assembly 18 for use in certain drilling operations is also shown and described.

The base assembly 12 includes a generally rectangular outer framework 21 with flattened corners and having a pair of spaced side members and a pair of spaced end members. These members preferably are made of hollow metal tubing connected at the ends by welding. One end of the framework is formed with an inset or notched portion 23 through which a pipe section of the drill assembly 14 extends. A generally rectangular inner framework 25 having a pair of spaced side members and a pair of spaced end members connected at the ends is connected in the outer framework. The engine support base 27 includes an L-shaped base plate secured inside the inner framework 25. Two engine hold-down brackets 28 are provided on the legs of the support base 27.

A pair of spaced vertical braces 31 is connected to and extends up from the side of the outer framework and a pair of spaced inclined upright braces 32 is connected to and extends up from the side of the inner framework. Vertical braces have a right angle support member 34 extending across the top and upright braces have a right angle support member 36 extending across the top to form an elevated support for the hydraulic fluid tank 38.

Figure 2:
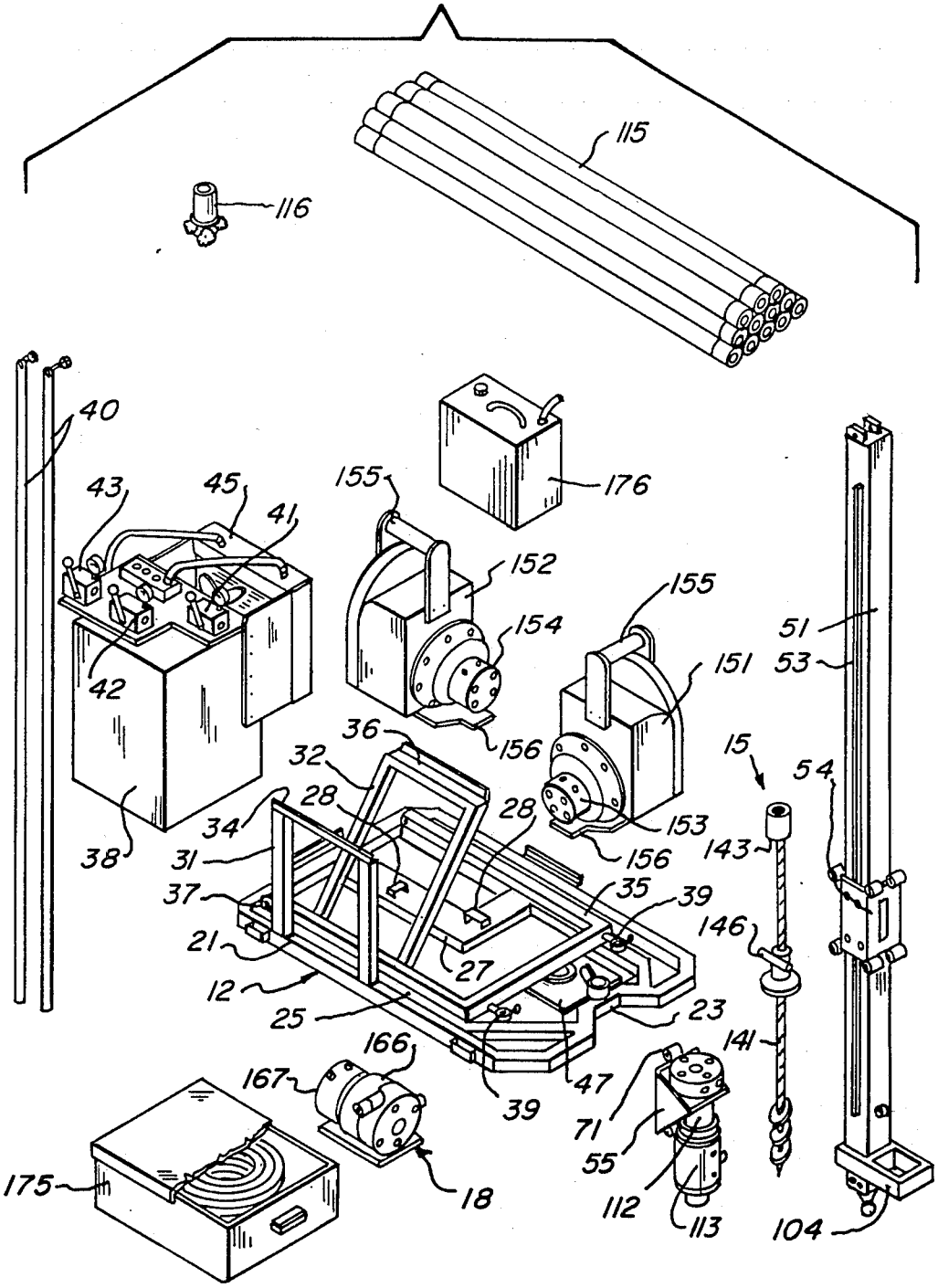
FIG. 2 is an exploded view of the apparatus shown in FIG. 1.
Figure 4:
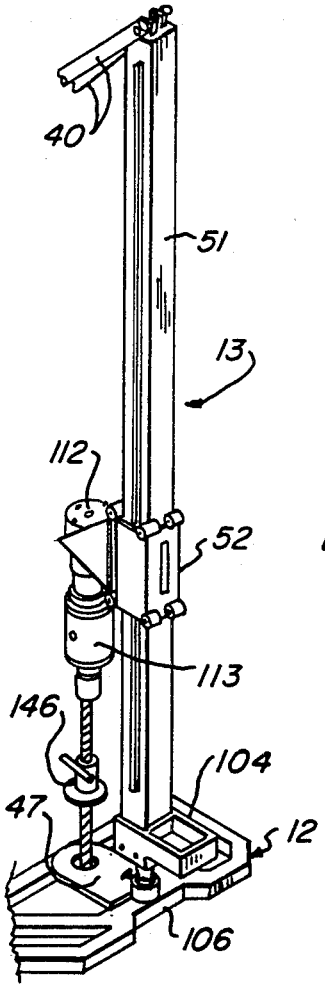
FIG. 4 is a perspective view of a portion of the apparatus showing the setting of the anchor.
Figure 5:
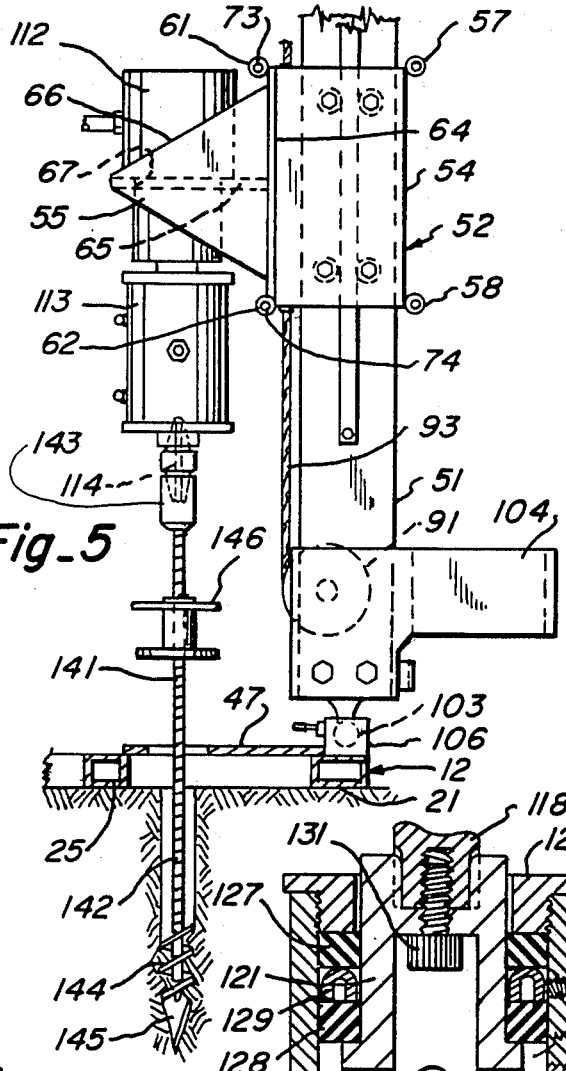
FIG. 5 is a side elevation of the apparatus of FIG. 4.

A U-shaped pivotal framework 35 is pivotally connected at the free ends at the corners of the inner framework 25 at pivots 37 and swings from a folded-down position shown in FIG. 2 to an upright position shown in FIG. 1. A pair of spaced eyebolts 39 is mounted on the transverse leg of this pivotal framework and each eyebolt receives a removable brace 40 that connects to the eyebolt and to the top end of the derrick to hold the derrick upright.

Control valves 41, 42 and 43 are shown mounted on the tank 38 and a cooling radiator 45 is mounted on an inner side of the tank. An anchor base plate 47 is supported between spaced parallel sections of the frameworks 21 and 25.

The derrick 13 has an elongated tubular member 51 of square cross section with a carriage 52 slidable along the tubular member. The tubular member has an elongated slot 53 along one side. The carriage 52 includes a sleeve portion 54 of square cross section telescoping over and spaced from the tubular member and a detachable support portion 55 projecting out from the sleeve portion adapted to mount adjacent an outer face of the tubular member for supporting the drill assembly 14 and adapted to mount adjacent an inner face of the tubular member for supporting the anchor assembly 15. The sleeve portion 54 has a window 56 in the back face.

The sleeve portion 54 carries a pair of alined projecting top sleeves 57 axially spaced from one another and a pair of alined projecting bottom sleeves 58 axially spaced from one another on an outer surface of the tubular member, as well as a pair of alined projecting top sleeves 61 axially spaced from one another and a pair of alined projecting bottom sleeves 62 axially spaced from one another on an opposite surface of the sleeve portion.

Figure 8:
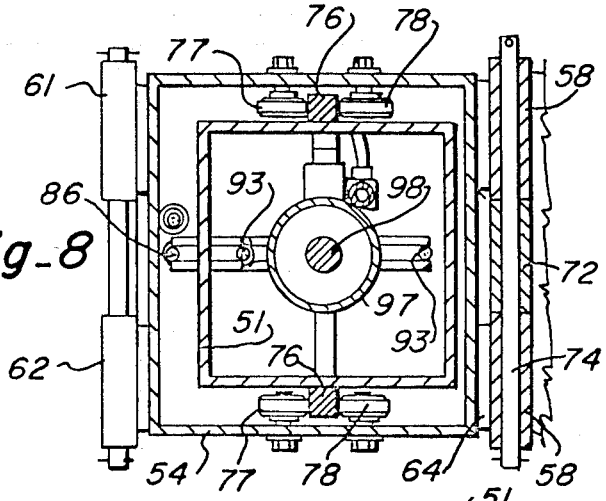
FIG. 8 is a sectional view taken along lines 8—8 of FIG. 7.
Figure 9:
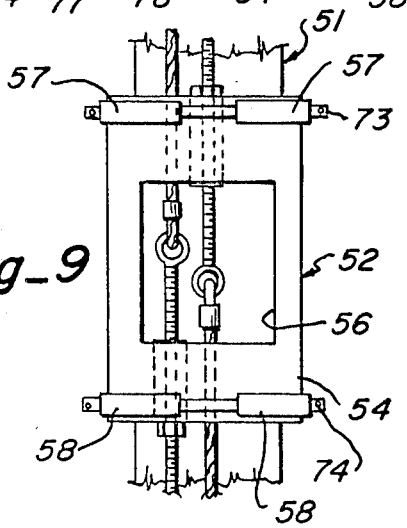
FIG. 9 is a view taken along lines 9—9 of FIG. 7.
Figure 11:
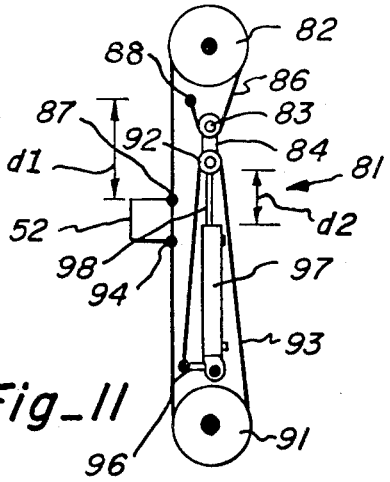
FIG. 11 is a schematic diagram of the pulley system of the derrick.

The support portion 55 shown has a back plate 64, a horizontal support plate 65 projecting out at right angles to the back plate, and V-shaped opposed end plates 66. The support plate 65 has an aperture 67 to accommodate the drill assembly. The back plate 64 has a top sleeve 71 and a bottom sleeve 72. Top sleeve 71 inserts between top sleeves 57 and bottom sleeve 72 inserts between bottom sleeves 58. A top pin 73 inserts through the alined top sleeves and a bottom pin 74 inserts between the alined bottom sleeves to removably fasten the support portion 55 to the sleeve portion of the carriage, as is shown in FIG. 8.

The carriage 52 is supported for guided movement up and down the tubular member by a pair of rectangular rails 76 on opposite sides of the tubular member and an upper set and a lower set of pairs of spaced idler wheels 77 and 78 associated with each rail carried on the inside of the sleeve portion that run up and down opposite track surfaces provided by the rails 76.

The carriage drive includes a block and tackle or pulley system 81 including a top fixed pulley 82 mounted within the upper end of the tubular member and an upper movable pulley 83 on a double block 84, together with a cable 86. Cable 86 has one end secured to the top of the carriage at 87 and extends from 87 around the top fixed pulley 82, around the movable pulley 83, and is secured at a fixed point 88 between pulleys 82 and 83.

A bottom fixed pulley 91 is mounted in the lower end of the tubular member. A lower movable pulley 92 is mounted on the double block 84 below and in spaced relation to pulley 83. A cable 93 is connected to the bottom of the carriage 52 at 94 and extends down around the bottom fixed pulley 91, up around the movable pulley 92, and is connected at the other end at a fixed point 96 between the two pulleys 91 and 92.

A two-way hydraulic cylinder 97 is mounted between the two pulleys and has the ram or cylinder rod 98 connected to the double block 84 so that when the ram is extended the carriage is lowered and when the ram is retracted the carriage is raised. The arrangement provides a distance advantage of 2:1 for the stroke of the carriage in relation to the stroke of the ram indicated by distances designated d1 and d2. The block and tackle 81 is mounted internally of the tubular member. Only a portion of pulleys 82 and 91 and associated cables 86 and 93 projects through slot 53.

The tubular member 51 has a closure cap 101 closing the top end and a closure cap 102 closing the bottom end to which a ball 103 is attached. A bottom flange 104 with an internal oblong socket is secured at the lower end of the tubular member. A removable guide collar 105 has a circular hole to accommodate the pipe section and an oblong exterior complementary in shape to the socket of guide 104 to prevent it from turning with the rotating pipe. The ball 103 fits in a socket 106 on the base assembly 12 so as to be readily removable from the base assembly.

The drill assembly 14 is comprised of the drill motor 112, an injector 113, a coupling 114, drill pipe sections 115 connected end to end, and a drill bit 116 connected to the lower pipe section. The pipe sections extend through the guide collar 105 to be supported against lateral movement. The drill motor 112 mounts on the support plate 65 and has a splined output shaft 118 extending through aperture 67.

The injector 113 is comprised of an inner sleeve 121 with a plurality of radially extending holes 122 and an outer cylindrical housing 123 with top and bottom removable end caps 124 and 125, respectively. These end caps have inset external threads that thread into internal threads in the ends of the housing. Axially spaced internal annular seals 127 and 128 and a gland ring 129 between the seals are provided at each end between the housing and sleeve for sealing purposes. A zerk 130 is shown connected to the outer housing to lubricate the gland rings.

The inner sleeve 121 has a splined internal surface that fits over the motor shaft 118 and is held by a bolt 131. The lower end of the internal sleeve has tapered internal threads into which one externally tapered threaded end of the coupling 114 is threaded. Mud passed into the injector from an external line 120 passes through holes 122, through a hole 133 in the coupling 114, through a hole 134 in a fitting 135 in the top section, and then through the pipe sections into the drill bit 116.

Figure 6:
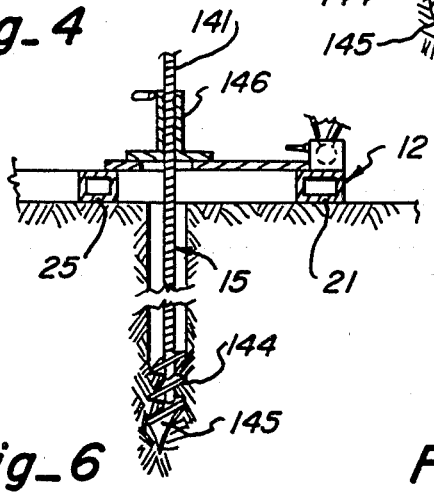
FIG. 6 is a side elevational sectional view showing the anchor in the anchoring position.
Figure 10:
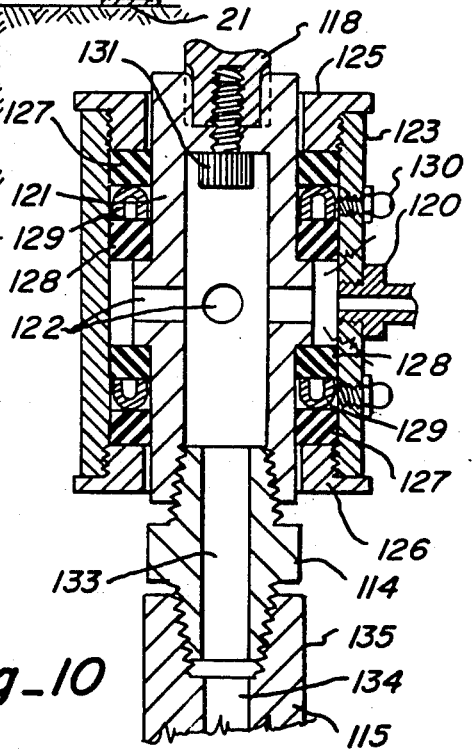
FIG. 10 is an enlarged sectional view of the injector.
Figure 7:
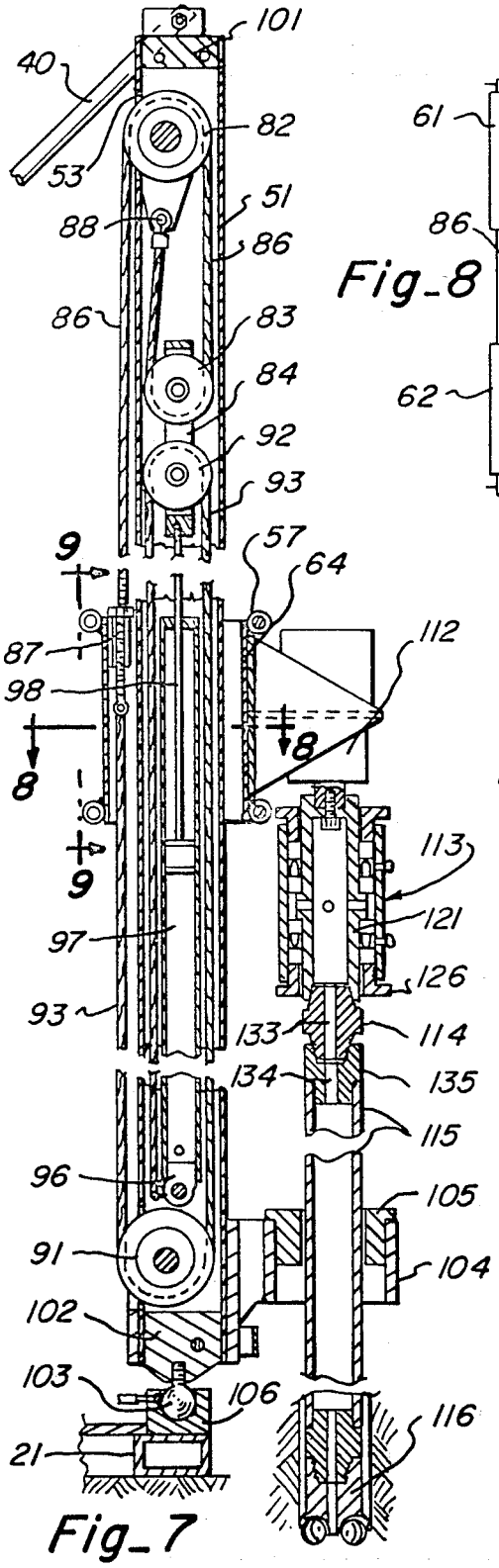
FIG. 7 is a sectional view taken along lines 7—7 of FIG. 1.

The anchor assembly 15 includes a length of rod 141 having coarse external threads 142 along the length thereof and preferably is made of spring steel. A top coupling 143 with tapered internal threads to receive coupling 114 connected to the injector is secured to the top end of the rod and the bottom end has a helical auger section 144 that terminates in a sharp spear-like pointed section 145. A spool-like hold-down collar 146 with internal threads is threaded up and down on the rod. The collar is threaded down against the anchor base plate to firmly anchor the base assembly 12 to the earth's surface, as seen in FIG. 6.

The prime movers for the hydrostatic drive system shown are two diesel engines 151 and 152 each driving hydraulic pumps 153 and 154, respectively, coupled to the associated engines. Each engine has a handle 155 to accommodate its being hand-carried and a base 156 that inserts into bracket 28 to facilitate its attachment to support base 27. Pumps 153 and 154 are connected parallel to one another in the hydraulic circuit so that either can supply fluid under pressure to the hydraulic loads being driven.

The drill motor 112 receives fluid under pressure over hydraulic line 157 through control valve 41 and a return hydraulic line 158 returns fluid from the drill motor to the cooler 45, which in turn has a return line 159 back to the tank 38.

To be extended, the hydraulic cylinder 97 receives fluid under pressure over hydraulic line 161 through control valve 42 and to retract over line 162 through control valve 42 so that the position of the carriage can be set according to the setting of control valve 42.

The optional mud pump assembly 18 has a hydraulic motor 166 that mechanically drives a mud pump 167. Pump 167 receives fluid under pressure from the pressure line 168 under the control of control valve 43, which in turn drives the mud pump 167 to force mud from a mud source 169 over line 120 into the injector 113 of the drill assembly if the drilling operation requires mud.

An alternative to the mud pump is to supply air under pressure as from a compressed air source when a percussion type drill bit is required.

The return line 159 connected to the cooling radiator returns cooled fluid to the tank. A fan 171 has a shaft 172 with an impeller 173 located under the discharge of the cooled return fluid. The falling fluid strikes the impeller 173 and turns the fan. This is a gravity cooling system that reduces the weight of the apparatus because no electric or hydraulic fan motor is required for cooling the fluid.

The drilling assembly shown in FIG. 1 is constructed and arranged to break down into several modules, which are illustrated in the exploded view in FIG. 2, so that each module weighs on the order of 130 pounds and may be hand-carried to the point of use and assembled. These modules as shown are comprised of:

A. The base assembly 12
B. The derrick 13 minus the drill assembly 14
C. A diesel engine 152 with hydraulic pump 154
D. A diesel engine 151 with hydraulic pump 153
E. Anchor 15, drill motor 112, injector 113, and support braces 40
F. Tank 38, control valves 41, 42 and 43, and cooling radiator 45
G. Pipe sections 115

Also carried to the point of use would be the diesel fuel in a tank 176 and the hydraulic lines in a container 175.

In use, the modules above described are transported to the point of use and assembled into the drill assembly, as shown in FIG. 1. The support portion 55 is positioned on the inside of the tubular member and the pins 73 and 74 inserted to lock it in place. The drill motor 112 is actuated and the auger section 144 of the anchor rod threads into the earth to a desired depth. The hold-down collar 146 is then threaded down against the anchor base plate to anchor base assembly 12 to the earth's surface.

The drill pipe 115 is coupled to the lower end of the injector 113 using the coupling 114, and the drill bit is fastened to the lower end of the pipe. The hydraulic cylinder 97 is actuated to lower the drill bit into the earth and the drill motor 112 is actuated to turn the bit. If the mud pump assembly 18 is coupled to the injector by line 120, mud is pumped through the pipe and drill bit 116 and pumps the cuttings out of the ground. Coupling 114 then serves to couple to either the anchor or the drill motor.

After the drilling is completed, the hydraulic cylinder retracts the pipe section from the hole. The anchor may be removed by removing the drill motor once it has been recoupled to the drive motor.

By way of illustration only, there are listed below devices which have been found suitable for use in the illustrated apparatus:

| Device | Rating | Model # | Manufacturer |
|---|---|---|---|
| Diesel engine 151, 152 | 13.8 hp 3000 rpm | | Ruggerini |
| Hydraulic pump 153, 154 | 12 gal/min | | Dowdty |
| Hydraulic motor 112 | 6000 ft lb torque 0–300 rpm | 100.7 | Nicholson |
| Drill bit 116 | 1" to 6" | | |
| Hydraulic cylinder | 2½" O.D. cyl ¾" O.D. ram 3 ft. stroke | | |
| Pipe | 1" to 5" | | |

The seals 127, 128 preferably are a Chevron V-packing having a slight taper of increasing width away from the end cap and appearing as U-shaped. These seals are of a resilient rubber material so that, as the cap is threaded in, the seals expand. The gland ring 129 has a slight taper in the same direction as the associated seals and allows the grease to get to the seals to lubricate them. The gland ring 129 is made of a rigid material such as aluminum, brass or plastic.

Although the present invention has been described with a certain degree of particularity, it is understood that the present disclosure has been made by way of example and that changes in details of structure may be made without departing from the spirit thereof.

What is claimed is:

1. Portable earth drilling apparatus comprising:
a base;
a derrick on said base, said derrick including a tubular member, a carriage having a sleeve portion telescoping over and movable on said tubular member, and drive means to move said carriage along said tubular member;
a drill assembly removably supported on said carriage, said drill assembly including a drill motor, a length of pipe, and a drill bit on the end of said pipe;
an anchor assembly supported on said base and set in place by said drill motor for anchoring the base to the earth; and
a drive system for selectively actuating said carriage and drill motor.

2. Portable earth drilling apparatus as set forth in claim 1 wherein said base is in the form of an open, generally rectangular framework of tubular members with a notched portion along one side through which a pipe section of the drill assembly extends.

3. Portable earth drilling apparatus as set forth in claim 2 wherein said base includes an outer rectangular framework, an inner rectangular framework connected inside the outer framework, a pivotal framework that supports braces to hold the derrick at its top end, and a support plate for the anchor supported between said inner and outer frameworks adjacent said notched portion.

4. Portable earth drilling apparatus as set forth in claim 1 wherein said carriage has a support portion projecting out from said sleeve portion, said support portion being releasably attached to one face for a drilling operation and to an opposite face for an anchoring operation.

5. Portable earth drilling apparatus as set forth in claim 4 wherein said support portion includes a back plate, a support plate and opposed end plates, and sleeve means aligned with projecting sleeve means on said sleeve portion through which at least one pin extends to removably fasten said support portion to opposite sides of said derrick.

6. Portable earth drilling apparatus as set forth in claim 1 wherein said drive means includes:
a block and tackle in said tubular member;
a first pulley;
a second pulley;
a first cable connected at one end to the carriage and extending around the first pulley, around said second pulley, and connected at the other end to a fixed point between said first and second pulleys;
a third pulley;
a fourth pulley;
a second cable connected at one end to the carriage and extending around said third pulley and said fourth pulley and connected at the other end at a fixed point between said third and fourth pulleys; and a two-way cylinder having a cylinder rod connected to said second and fourth pulleys to move said second and fourth pulleys in one direction whereby to move the carriage in one direction and to move said second and fourth pulleys in the opposite direction whereby to move said carriage in the opposite direction.

7. Portable earth drilling apparatus as set forth in claim 1 wherein said base forms a first module, said derrick less the drill assembly a second module, said anchor and drill assembly a third module, and power units forming a part of the drive system form the fourth and fifth modules, said modules being on the order of 130 pounds to be hand-transported to the point of use.

8. Portable earth drilling apparatus as set forth in claim 1 wherein said carriage is driven by a two-way hydraulic cylinder and said drill motor is a rotary hydraulic motor, said drive system including at least one engine and a hydraulic pump driven by said engine for supplying fluid under pressure through a first control valve to said cylinder and a second control valve to said drill motor.

9. Portable earth drilling apparatus as set forth in claim 1 wherein said anchor assembly includes a rod with external threads, a top coupling, a helical auger on the lower end that terminates in a spear-like pointed section, and a hold-down collar that threads up and down on said rod and against a base plate on said base to anchor said base to the earth's surface.

10. Portable earth drilling apparatus as set forth in claim 1 wherein said drill assembly includes an injector coupled between said drill motor and said pipe to supply mud or air into said pipe and to said drill bit.

11. Portable earth drilling apparatus as set forth in claim 10 wherein said injector includes an inner sleeve with a plurality of radially extending holes, an outer housing, end caps, axially spaced annular seals, and a gland ring between the seals at each end and between said inner sleeve and said housing to seal the fluid pressure applied to said holes.

12. Portable earth drilling apparatus as set forth in claim 1 wherein said derrick has a ball at the lower end that removably inserts in a socket in said base.

13. Portable earth drilling apparatus as set forth in claim 1 wherein said derrick has a bottom flange with an oblong socket into which a guide collar is removably inserted, said guide collar having a circular hole to accommodate the pipe of the drill assembly and an oblong exterior complementary in shape to said socket.

14. Portable earth drilling apparatus as set forth in claim 1 including a cooling fan having a shaft and an impeller, said impeller being driven by the return flow in the hydraulic circuit, said fan being adjacent a cooling radiator through which return fluid is passed to cool the return fluid.

15. Hand-transportable earth drilling apparatus comprising:

a base assembly made up of an open framework of tubular members;

a derrick removably mounted on said base, said derrick including a tubular member, a carriage having a sleeve portion telescoping over and movable on said tubular member, and drive means including a block and tackle and a two-way hydraulic cylinder in said tubular member to move said carriage along said tubular member;

a drill assembly removably supported on said carriage, said drill assembly including a hydraulic drill motor, a length of pipe, and a drill bit;

an anchor assembly supported on said base and set in place by said drill motor for anchoring the base to the earth; and a hydrostatic drive system for selectively actuating said carriage, said hydraulic cylinder and said drill motor.

16. Hand-transportable rotary earth drilling apparatus comprising:

a base;

a derrick releasably attached to said base, said derrick including a tubular member, a carriage having a sleeve portion telescoping over and movable up and down on said tubular member, said sleeve portion having opposite faces, a support portion projecting out from said sleeve portion. said support portion being releasably attached to one of said faces for a drilling operation and to the other of said faces for an anchoring operation, and drive means within said tubular member to move said carriage along said tubular member, said drive means including:

a block and tackle in said tubular member, a first pulley, a second pulley, a first cable connected at one end to the carriage and extending around the first pulley, around said second pulley, and connected at the other end to a fixed point between said first and second pulleys, a third pulley, a fourth pulley, a second cable connected at one end to the carriage and extending around said third pulley and said fourth pulley and connected at the other end at a fixed point between said third and fourth pulleys, a two-way cylinder having a cylinder rod connected to said second and fourth pulleys to move said second and fourth pulleys in one direction whereby to move the carriage in one direction and to move said second and fourth pulleys in the opposite direction whereby to move said carriage in the opposite direction, a drill assembly on said support portion including:

a drill motor, a fluid injector section, a length of pipe coupled by a coupling between the injection section and the top end of the pipe, a drill bit on the bottom end of said length of pipe;

an anchor assembly secured to said base for extending into the earth to anchor the base to the earth; and a hydrostatic drive system on said base to selectively actuate said carriage and said drill motor.

17. An anchor assembly for a portable earth drilling apparatus having a base and a derrick and drill assembly supported by the base for drilling holes in the earth, said anchor assembly comprising:

a base plate on said base;

a rod extending through said base plate having an earth penetrating pointed lower end and a top end adapted to be coupled to a drive to rotate said rod to advance said rod into the earth and to retract said rod from the earth; and hold-down means adapted to move along said rod to bear against the base plate when the rod is in an extended earth-penetrating position to anchor the base to the earth's surface.

* * * * *